United States Patent [19]

Diercks, Jr.

[11] Patent Number: 4,610,449

[45] Date of Patent: Sep. 9, 1986

[54] AUTOMATIC WEIGHT SELECTOR

[76] Inventor: George F. Diercks, Jr., 75 Balin Ave., So. Setauket, N.Y. 11720

[21] Appl. No.: 769,456

[22] Filed: Aug. 26, 1985

[51] Int. Cl.[4] ..... A63B 21/06

[52] U.S. Cl. ..... 272/118; 272/134; 272/DIG. 4

[58] Field of Search ..... 272/118, 117, 93, DIG. 4, 272/134, 116, 123; 273/35 R, 193 A, 183 R

[56] References Cited

U.S. PATENT DOCUMENTS

| | | | |
|---|---|---|---|
| 3,400,793 | 9/1968 | Norris et al. | 272/901 X |
| 3,573,865 | 4/1971 | Annas | 272/117 |
| 3,731,922 | 5/1973 | Jungreis | 272/117 |
| 4,063,726 | 12/1977 | Wilson | 272/DIG. 4 X |
| 4,538,805 | 9/1985 | Parviainen | 272/118 |
| 4,540,171 | 9/1985 | Clark et al. | 272/123 X |
| 4,546,971 | 10/1985 | Raasoch | 272/118 |
| 4,563,003 | 1/1986 | Bugallo et al. | 272/118 |

*Primary Examiner*—Richard J. Apley
*Assistant Examiner*—Robert W. Bahr
*Attorney, Agent, or Firm*—Leonard Belkin

[57] ABSTRACT

An automatic weight selector for pin selected exercise equipment in which a timer is employed to reduce the weight load after a predetermined period of time. The timing device is suspended from a first pin engaging a weight and has a second pin for engaging a lower weight. The second pin is biased out of engagement with the weight and a timer controlled cam is utilized to maintain the second pin in engagement with the weight. After a predetermined period of time the second pin is released and the total weight load is then established by the upper pin.

12 Claims, 8 Drawing Figures

AUTOMATIC WEIGHT SELECTOR

BACKGROUND OF THE INVENTION

This invention relates to an automatic weight selector for pin selected exercise equipment and more particularly to an arrangement for use with such equipment to automatically change the selected weight after a predetermined period of time.

One of the most dramatic changes in body building has occurred during the past forty years with the development of sophisticated exercise equipment to replace the barbell as the means to exercise the torso. Among the many drawbacks of the barbell is its inability to provide variable resistance, its lack of adaptability to provide adequate rotary resistance around the axis of a joint, and inability to provide direct resistance to specific muscles.

Modern exercise machines have overcome successfully these drawbacks of the barbell and offer to the trainee a high degree of flexibility in the application of forces which can be precisely controlled and recorded. In one typical type of exercise machine now on the market, the resistive force to be applied is selected from a stack of weights utilizing a pin which is moved, so-called pin selected exercise equipment. The trainee inserts a pin for the number of weights to be lifted in applying the resistive force to his muscles. The machine itself involves a variety of devices to apply resistive forces to virtually any muscle in the anatomy of the trainee, each with its own set of pin selected weights.

It is known that to obtain maximum benefit from any exercise program, it is necessary to exert maximum force against a fixed resistance for isotonic contraction of muscles until the muscles begin to tire. It has come to be understood that it is the intensity of training rather than the total amount of training which will result in maximum size and strength of muscles. For certain muscles intensity of training can be increased beyond that obtained by merely exerting the maximum force against a fixed resistance by utilizing a procedure known as breakdown training.

In breakdown training, the trainee works to exhaustion with a given weight and then quickly reduces the resistance and works to failure again.

At present, a trainee utilizing breakdown training requires either the assistance of a second person to move the pin in a pin selected weight system or he has to stop exercising to make the change himself, in many cases, having to step off the equipment. This requirement tends to discourage the use of breakdown training.

SUMMARY OF THE INVENTION

In the present invention, the above noted disadvantages in utilizing pin selected exercise equipment for breakdown training are overcome or substantially reduced by providing apparatus for automatically stepping down the weight after a predetermined period of exercising.

In a preferred embodiment of this invention there is provided a pin selected weight lifting machine having a stack of weights, a center bar passing through said weights, and a pin for passing through a selected weight for engagement with said center bar causing said weight and all weights stacked above to be lifted with said center bar. For engagement with said pin there is a device to establish an increased weight load and a timer to eliminate said increased weight load after a predetermined period of time.

In such an arrangement the trainee can start out with a total lifting weight at or near his capacity and then have it automatically reduced after a predetermined time so that he can continue exercising at the reduced weight.

It is thus a principal object of this invention to provide apparatus for automatically reducing lifting weight in an exercising machine after a predetermined period of time.

Other objects and advantages of this invention will hereinafter become obvious from the following description of preferred embodiments of this invention.

DETAILED DESCRIPTION OF THE PREFERRED EMBODIMENTS

Figure 1:
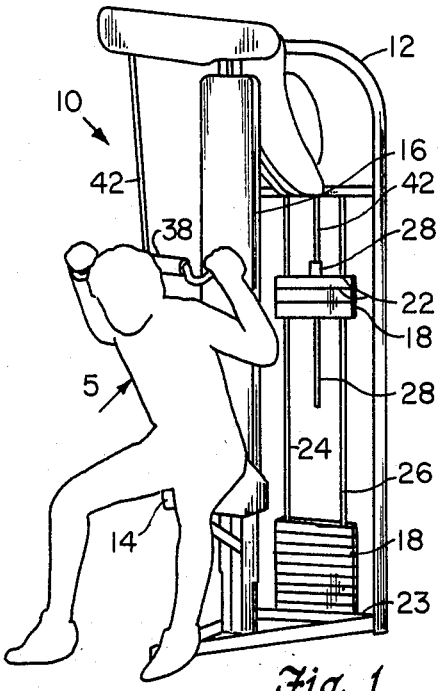
FIG. 1 is an isometric view of a trainee utilizing an exercise machine having pin selected weights.

Referring to FIG. 1, there is shown a trainee 5 using a torso arm machine of the type to which this embodiment of the invention pertains. Machine 10 consists of a frame 12 supporting a seat 14, a back rest 16, and a stack 18 of weights. Stack 18 is formed from identical flat weights 22 typically weighing ten pounds each so that twenty of them could be stacked in a particular machine although it is understood that there are a variety of different machines for different exercises all using weight stacks and the number and value of the weights may vary.

Figure 2:
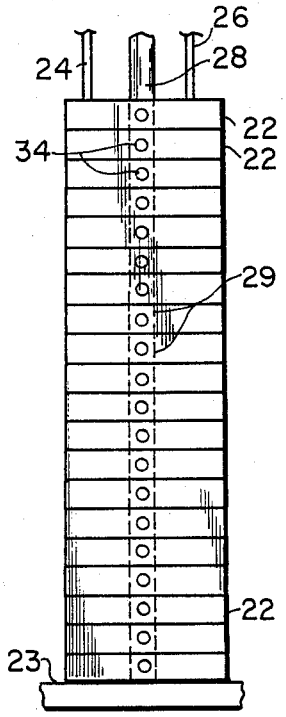
FIG. 2 is a front view of a stack of weights employed in such a machine.

Weights 22 rest on a cross member 23 and ride when lifted on a pair of stationary guides 24 and 26 passing through matching holes in the weights. A center or lifting bar 28 attached to the top weight passes down through center holes 29 aligned in weights 22 as seen in FIG. 2. Bar 28 has equispaced holes 32 which line up with holes 34 in weights 22 as shown in FIG. 2. Bar 28 and the aligned vertically directed center holes 29 may be of any convenient cross section such as circular, square or rectangular.

Figure 3:
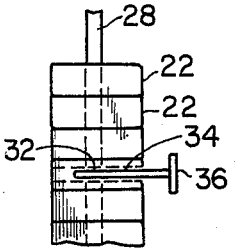
FIGS. 3 and 4 are partial side views of the stack of weights shown in FIG. 2 illustrating how the weights are lifted.

When the trainee wishes to exercise using four weights totaling 80 lbs., for example, a pin 36 is inserted in hole 34 in the fourth weight from the top as shown in FIG. 3, pin 36 passing through hole 32 in center bar 28 aligned with that hole. As seen in FIG. 1, the trainee then pulls down on handle 38 connected to a cable 42 which rides over a pulley system not shown and is connected to center bar 28.

Figure 4:
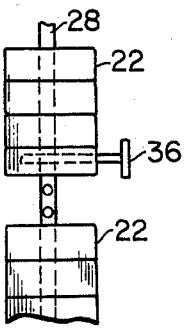

As center bar 28 is raised as shown in FIGS. 1 and 4, the weight 22 attached by pin 36 to center bar 28 and those weights above it are raised, hence, the trainee is pulling against a force of 80 lbs.

The present invention makes it possible for the trainee to pull a particular number of weights for a predetermined time period followed by a reduction in the number of weights automatically and without any special effort on his part or the assistance of another person.

Figure 5:
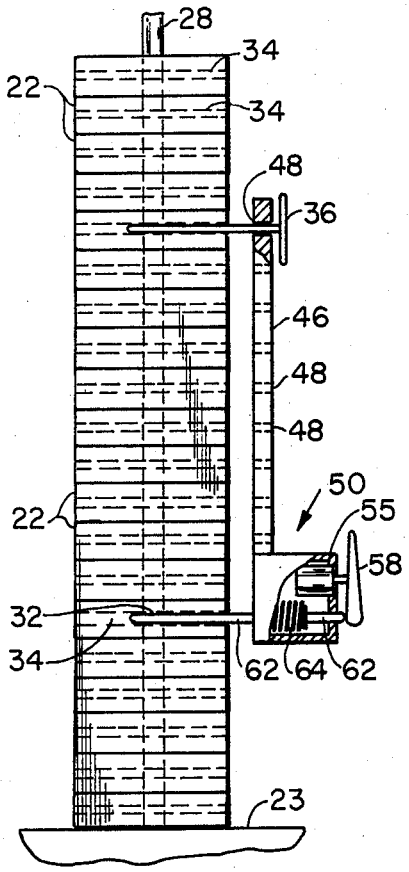
FIG. 5 is a side view of the stack of weights shown in FIG. 2 with a preferred embodiment of this invention mounted in place.

Referring to FIG. 5, the stack of weights 22 with center bar 28 is shown in its resting position with pin 36 at some appropriate level. Located on and extending down from pin 36 is an elongated plate 46 with holes 48 large enough to accommodate pin 36 and equi-spaced to line up with holes 34 in weights 22. In FIG. 5, pin 36 passes through the uppermost hole 48 in plate 46.

Figure 6:
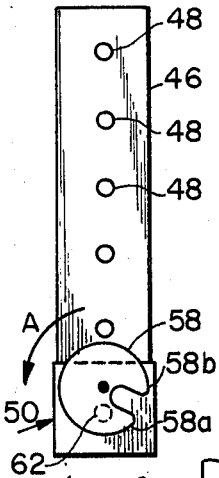
FIG. 6 is a view from the right of the plate employed in FIG. 5.
Figure 7:
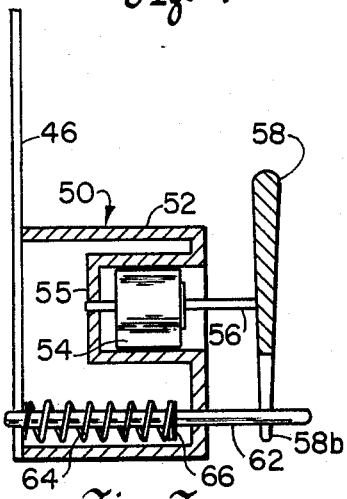
FIG. 7 is an enlarged detail view of the timing device taken along 7—7 of FIG. 6*a*.
Figure 6A:
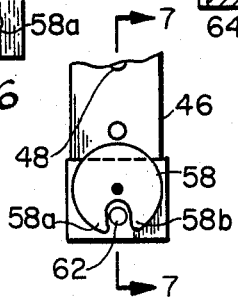
FIG. 6*a* shows the cam in its wind up position.

As seen also in FIG. 7, mounted on the bottom of plate 46 is a timer assembly 50 which consists of a housing 52 attached to plate 46 containing a timer 54 within a well 55 with a protruding shaft 56 terminating in and supporting a cam member 58 of crescent configuration for a purpose to be later described. A slidable pin 62 preferably having a diameter less than the diameter of pin 36 extends completely through housing 52 so that its left end passes through plate 46 and its right end extends past cam member 58. A spring 64 wrapped around pin 62 between plate 46 and a stop 66 on pin 62 biases the latter to the right, the position shown in FIG. 7. When pin 62 is pushed to the left it enters the opening 34 in a weight 22 and passes through an opening 32 in center bar 28 aligned with that particular weight as seen in FIG. 5. Cam member 58 is rotated clockwise so that the latter prevents pin 62 from moving out of center bar 28 as seen in FIGS. 5 and 6. The rotation of cam member 58 clockwise winds up timer 54 and it begins to wind down in a counter clockwise direction shown by arrow A in FIG. 6 and turning cam member 58 back into its initial position shown in FIGS. 6*a* and 7 where pin 62 is retracted from engagement with its weight 22.

After cam 58 is rotated clockwise to wind up timer 54, pin 62 is biased against end 58*a* of cam 58 as seen in FIG. 6. End 58*a* is the thickest portion of cam 58 which narrows in thickness over its curved length until the thinnest portion is reached at end 58*b* in order to reduce friction resistance to rotating of cam 58 as timer 54 unwinds. Thus, in FIG. 5 with timer 54 wound up and FIG. 7 with timer 54 wound down it is seen how the thickness of cam 58 varies. Timer 54 is a conventional spring wound device with an escapement mechanism to control the rate of unwinding commonly available and the details of its construction form no part of this invention.

While pin 62 is held into engagement with center bar 28 as seen in FIG. 5, the trainee is exercising utilizing all of the weights held by pin 62. When the period of time clocked off by timer 54 is completed, cam member 58 is back in its initial position shown in FIG. 7 but pin 62 will not move to the right through the crescent in member 58 until trainee 5 rests the weights due to the friction of pin 62 against the upper surface of hole 34 in its weight. The diameter of pin 62 is less than the diameter of hole 34 to insure that it will slide out without resistance once weight 22 comes to rest. A typical time elapse operation for timer 54 can be 30 seconds although it is understood that this can be changed and in fact the time elapse can be reduced by not turning cam member 58 its maximum number of degrees of rotation. Also, the trainee can extend the time for carrying the higher weight load by not bringing the weights to rest. The friction of pin 62 against the upper surface of hole 34 in the weight as already noted will prevent withdrawal until the load is released by bringing the weights to rest so that in effect the trainee has complete control without any extra activity on his part. When pin 62 under the effect of spring 64 is moved to the right as shown in FIG. 7, there is a reduction in the lifting weights by releasing all the weights below pin 36 and the trainee can continue his exercising with the weights lifted by pin 36. The effect of pin 62 having a diameter less than pin 36 is to permit release of the former by barely resting the weights without completely eliminating the weight on pin 36.

The trainee can select the number of weights to be eliminated when the reduction in weight occurs. This is accomplished by selecting the hole in plate 46 through which pin 36 may be inserted. Thus in FIG. 5, a reduction of ten weights will take place. However, if pin 36 were inserted in the second hole from the top of plate 46, then pin 62 will engage center bar one hole or one weight higher so that the reduction will be one less, or nine weights.

In the arrangement just described it is seen that it is readily adaptable for use in any pin selected weight system and that it is simple to install and operate. No tools are required and very little instruction is required to familiarize a trainee with its use.

The use of this invention makes it possible for trainees to move through the exercise equipment using breakdown training more rapidly than has heretofore been possible since neither assistance is needed nor time out required to move the pin to reduce the load.

While only a preferred embodiment of this invention has been described it is understood that many variations are possible without departing from the principles of this invention as defined in the claims which follow.

What is claimed is:

1. In a pin selected weight lifting machine comprising a stack of weights having aligned vertical openings therethrough, lifting means passing through said vertical openings in said weights, each of said weights having an opening transverse to its vertical opening to permit communication with the latter, and means comprising a first pin for passing through a transverse opening in a first weight for engaging said first weight with said lifting means for permitting said first weight and all weights stacked above to be lifted with said lifting means, the improvement comprising means attached to said pin for adding additional weights to said weights being lifted thereby establishing an increased weight load on said lifting means and including means adapted to permit automatic release of only said additional weights after a predetermined period of time, where the first weight and all the weights stacked above the first weight will continue to be lifted by the lifting means.

2. Apparatus as set forth in claim 1 in which said automatic releasing means includes timing means for establishing said predetermined period of time.

3. Apparatus as set forth in claim 1 in which the attaching means extends down from said first pin and includes means to engage a second weight below said first weight so that as the latter is raised said second weight and all weights above said second weight are raised.

4. Apparatus as set forth in claim 3 in which the attaching means includes a plate suspended from said pin, said means to engage said second weight including a second pin adapted to engage said second weight.

5. Apparatus as set forth in claim 4 having means to bias said second pin out of engagement with said second weight, and timer means for overcoming said bias so as to release said second weight from said second pin after said predetermined period of time.

6. Apparatus as set forth in claim 5 in which said first pin passes through said first weight and said plate.

7. Apparatus as set forth in claim 6 in which said bias means comprises a spring to bias said second pin away from passing through said second weight.

8. Apparatus as set forth in claim 7 in which said timer means comprises a timer and cam means rotated by said timer after the latter is set for a predetermined period of time, said cam means being in engagement with said second pin to overcome said bias while being rotated by said timer and releasing said second pin after the elapse of said predetermined period of time.

9. Apparatus as set forth in claim 8 in which said plate includes means to select the second weight.

10. Apparatus as set forth in claim 8 in which said plate has a plurality of vertically spaced openings to accommodate both of said pins, the selection of the opening for said first pin permitting the selection of said second weight.

11. Apparatus as set forth in claim 10 in which said cam means comprises crescent shaped cam with a thickness which decreases as the timer unwinds to reduce resistance to rotation.

12. Apparatus as set forth in claim 11 in which said second pin has a smaller diameter than the hole in said second weight.

* * * * *